United States Patent [19]

Pasternack

[11] Patent Number: 4,459,822

[45] Date of Patent: Jul. 17, 1984

[54] COOLING SUIT SYSTEM AND HEAT EXCHANGER CONSTRUCTION

[75] Inventor: Adalbert Pasternack, Bad Schwartau, Fed. Rep. of Germany

[73] Assignee: Drägerwerk A.G., Fed. Rep. of Germany

[21] Appl. No.: 342,141

[22] Filed: Jan. 25, 1982

[30] Foreign Application Priority Data

Jan. 26, 1981 [DE] Fed. Rep. of Germany ..... 3102443

[51] Int. Cl.[3] ..... F25D 23/12

[52] U.S. Cl. ..... 62/259.3; 62/125; 2/2.1 R

[58] Field of Search ..... 62/259.3; 128/142.5, 128/212, 379, 399, 402, 403; 2/2.1 R, 2.1 A

[56] References Cited

U.S. PATENT DOCUMENTS

| | | | |
|---|---|---|---|
| 3,212,286 | 10/1965 | Curtis | 62/259.3 |
| 3,316,732 | 5/1967 | Burton | 62/259.3 |
| 4,286,439 | 9/1981 | Pasternack | 62/259.3 |

*Primary Examiner*—Albert J. Makay
*Assistant Examiner*—Henry Bennett
*Attorney, Agent, or Firm*—McGlew and Tuttle

[57] ABSTRACT

A cooling suit system comprises a suit which is adapted to be worn by a person and which has a cooling media flow conduit therein for circulating a cooling media therethrough. A heat exchanger is associated with the suit and is advantageously adapted to be carried on the back of the wearer and it includes an inlet to the heat exchanger which is connected from the flow conduit into an insert of elastic material arranged within the housing of the heat exchanger. An outlet connects the lower end of the insert to the cooling media flow conduit downstream of the inlet. The insert is filled with a cooling media in the form of meltable solid pieces of ice and it is elastically constructed so that it tightly engages around the ice and may compress with the ice in its liquid form from the thawing of the ice. The construction advantageously includes a pressurizable space in the heat exchanger housing surrounding the insert having an excess pressure valve for regulating the pressure of air which is blown into the space by an air supply pump. The pressure is selected so that the insert will be aided in tightly engaging around the ice during the thawing process. The liquid which is cooled by the ice is circulated by a pump through the outlet connection to the cooling media flow conduit of the suit.

6 Claims, 1 Drawing Figure

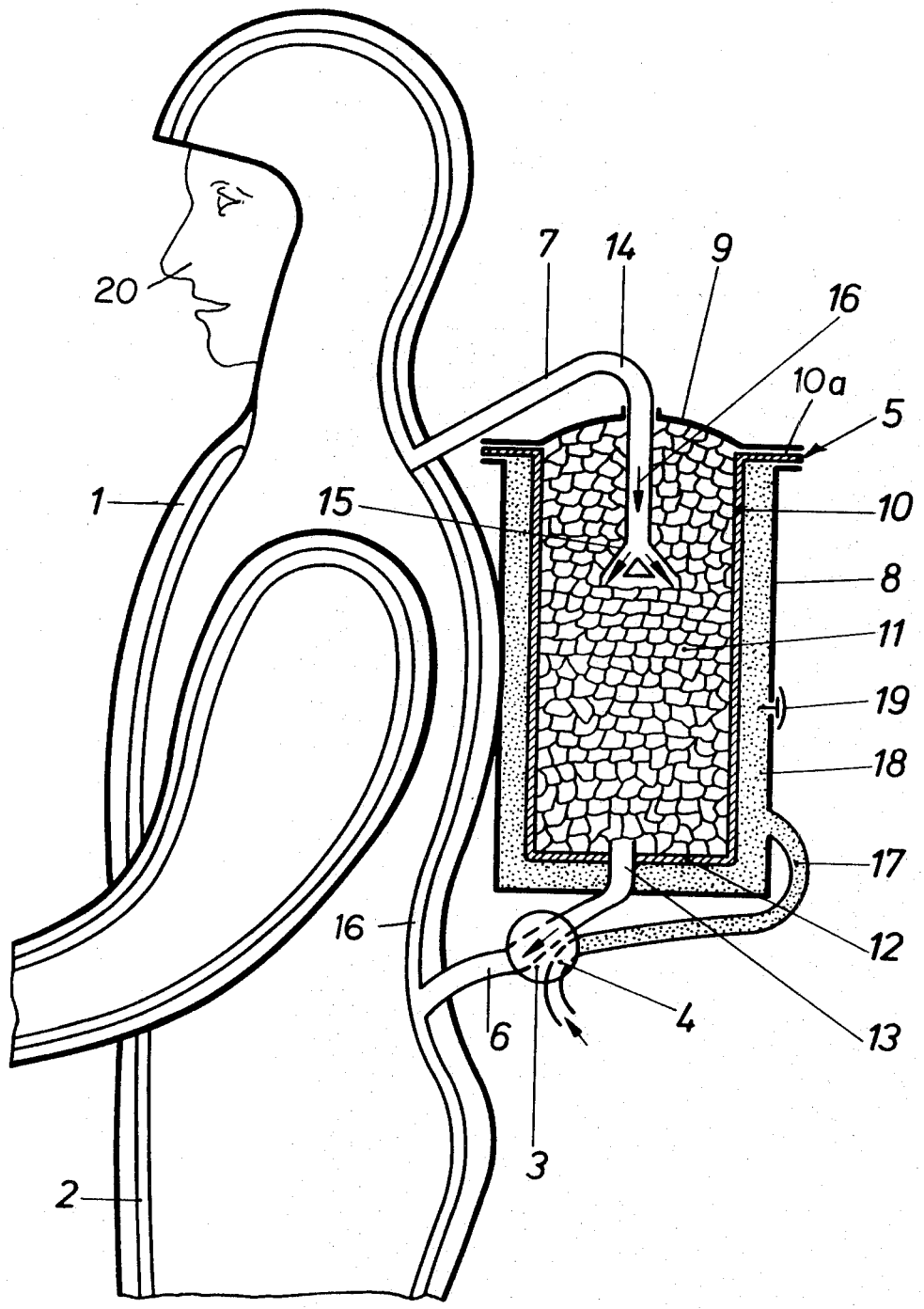
20
7
14
9
16
10a
5
1
15
10
8
11
19
18
17
16
12
4
13
6
3
2

COOLING SUIT SYSTEM AND HEAT EXCHANGER CONSTRUCTION

FIELD AND BACKGROUND OF THE INVENTION

This invention relates in general to personnel protection garments and in particular to a new and useful cooling suit system and heat exchanger construction therefor.

Due to metabolism, the human body continuously produces heat This heat is normally dissipated to the ambiance by radiation, conduction, convection and evaporation. The necessary equilibrium at which the body temperature does not exceed the physiological limits can be obtained only if the ambiance is capable of absorbing the heat as fast as it is produced. The heat from the body fails to be directly dissipated if the temperature of the ambiance exceeds the permissible upper temperature limit of the human body.

A prior art device for controlling the body temperature heats or cools the skin. Ventilated pressure suits worn by pilots are an example of such a system. In a suit of this kind, a plurality of parallel, flexible conduits is incorporated, through which a liquid refrigerant is circulated. The conduits form a circuit and their ends are connected to a delivery pump and a heat exchanger. In a specific embodiment, the heat exchanger contains ice as a solid granular refrigerant. The circulating heat carrier is water which is pumped directly through the thawing ice where it gives up the heat absorbed during its flow through the flexible conduits of the suit. What is disadvantageous is that the varying total volume of the heat carrier and ice, i.e. the produced water and diminishing amount of ice, cannot be balance. This primarily affects the direct heat exchange between the water and the individual ice particles (British Pat. No. 992,929).

SUMMARY OF THE INVENTION

The invention is directed to an improved heat exchange between the ice and the heat carrier to best utilize the favorable circumstances of employing ice which is available everywhere and easily handled.

In accordance with the invention a cooling suit is provided with a conduit or conduits for circulating a cooling media therethrough which is connected through an inlet into a heat exchanger housing having an insert therein of elastic material which contains pieces of a solid refrigerant such as ice which is meltable. The insert is made of flexible material so that it tightly engages the ice and the thawing liquid as it is formed. In addition, air is circulated in a space between the insert and the interior of the heat exchanger in order to maintain a pressure on the insert to facilitate its tightly engaging the ice and the thawing liquid. A pump is used to circulate the liquid which is cooled in the heat exchanger back through the conduit of the suit.

The principal advantage of the invention is that the heat transferring contact between the liquid refrigerant and the ice as a refrigerating agent remains constant. With a diminishing ice volume, the flexible insert pushes the ice lumps and the liquid heat carrier against each other always with the same pressure. This is obtained in a simple way through the pressure in the intermediate space between the outer vessel and the insert. The insert, made of a flexible material, is permanently pressed against the ice lumps and thus also against the heat carrier circulating therebetween. Not only a spatial compensation but also a positionally independent operation is thereby ensured.

Accordingly it is an object of the invention to provide a cooling suit system which includes a suit having a conduit defined therethrough which is connected through a heat exchanger which is adapted to be carried on the wearer of the suit's back and which includes an insert in the heat exchanger made of elastic material so that it tightly engages solid meltable refrigerants through which the cooling media is circulated.

A further object of the invention is to provide a heat exchanger in a cooling suit wherein there is an insert of flexible material in the heat exchanger housing which tightly engages the solid multiple coolant and which also includes means for pressurizing the space around the insert so that it is always maintained in tight engagement with the refrigerant as it melts.

A further object of the invention is to provide a cooling suit and a heat exchanger construction which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWING

The only FIGURE of the drawing is a schematic partial view of a person having a cooling suit with the improved cooling suit system and heat exchanger construction of the invention.

DETAILED DESCRIPTION OF THE PREFERRED EMBODIMENT

Referring to the drawings in particular the invention embodied therein comprises a cooling system comprising a cooling suit 1 adapted to be worn by a person 20 and which has one or more conduits 2 extending therethrough for the circulation of a heat transfer medium particularly a coolant in liquid form. Associated with the suit 1 is a heat exchanger generally designated 5 which is connected to the conduit 2 so as to circulate a liquid coolant through the conduit and which includes a housing having a flexible insert inside which contains a meltable solid coolant such as ice pieces and which is made of flexible material so that it tightly engages around the ice during the melting thereof as the liquid is circulated through the coolant and through the conduit of the suit.

The user wears a cooling suit 1 equipped with an ice cooling system. This system comprises conduits 2 which are provided in the interior of the suit 1, a pump 3 which is equipped with an air supply device, a heat exchanger 5, and lower and upper connecting lines 6 and 7 for establishing a circuit including the conduits 2, the pump 3 and the heat exchanger 5.

The heat exchanger 5 comprises an outer vessel or housing 8 having a cover 9. The housing 8 accommodates a flexible insert 10 (of rubber, for example), which is filled with pieces or lumps of ice 11 The insert 10 is held in position by clamping its rim 10*a* between the vessel 8 and the cover 9. A suction outlet 13 forming a part of the lower connection line 6 extends tightly through bottom 12 of insert 10. A pressure inlet 14 extends tightly through cover 9 and terminates in a distributor fitting 15 providing a division of flow for a heat transfer medium such as a liquid.

The system of conduits 2 is advantageously filled with a medium comprising liquid refrigerant 16, such as alcohol or oil. The refrigerant 16 completely fills up the interspaces between the individual ice lumps 11 and flows in the direction of an arrow 16*a*. The circulating refrigerants take up the water of the thawing ice. Pump 3 circulates refrigerant 16 through the entire ice cooling system.

An air supply device or pump portion 4 of the pump 3 is connected to the intermediate space 18 formed between outer vessel 8 and flexible insert 10, through a flexible tube 17. This device 4 forces ambient air into intermediate space 18 until a selected pressure in the outer vessel 8 is reached; which is adjusted by an adjustable excess-pressure valve 19, and then it is switched off by a control associated with the valve. It switches on again as soon as the pressure drops, e.g. to one third of the pressure adjusted by the valve, si that intermediate space 18 is filled up again. Flexible insert 10 is thus exposed to the pressure present in intermediate space 18. This is the pressure with which ice lumps 11 and liquid refrigerant 16 are then compressed. The volume of the refrigerant space varies with the thawing of the ice lumps 11 so that the thawing is thereby accounted for and the heat transfer between the ice and the liquid refrigerant remains constant.

While a specific embodiment of the invention has been shown and described in detail to illustrate the application of the principles of the invention, it will be understood that the invention may be embodied otherwise without departing from such principles.

What is claimed is:

1. A cooling suit syxtem, comprising a suit adapted to be worn by a person having a cooling media flow conduit associated therewith, a heat exchanger associated with said suit having a housing, a coolant media inlet connected into said housing from said flow conduit, a coolant media discharge connected from said housing back to said flow conduit downstream of said coolant media inlet; a flexible insert in said housing connected to said inlet and to said outlet and containing a cooling media comprising meltable solid pieces, said insert elastically tightly engaging said pieces, said housing defining a pressurizable space surrounding said insert, a pump for air connected into said housing into the space surrounding said insert to pressurize said space.

2. A cooling suit system, comprising a suit adapted to be worn by a person having a cooling media flow conduit associated therewith, a heat exchanger associated with said suit having a housing, a coolant media inlet connected into said housing from said flow conduit, a coolant media discharge connected into said housing from said flow conduit downstream of said cooling media inlet, a flexible insert in said housing connected to said inlet and said outlet and containing a cooling media comprising multiple solid pieces, said insert elastically tightly engaging said pieces, and means to circulate said coolant from said flow conduit into said heat exchanger in said insert and from said insert back into said cooling media flow conduit, said means comprising a pump disposed in said outlet and having a separate portion supplying air to said heat exchanger housing pressurizable space.

3. A cooling suit system according to claim 2, including an excess pressure valve on said housing connected into said pressurizable space and adapted to be connected to said pump for maintaining said pressurizable space at a preselected pressure.

4. A cooling suit system according to claim 1, wherein a liquid refrigerant comprising alcohol is circulated through said flow conduit to said heat exchanger.

5. A cooling suit according to claim 1, wherein liquid refrigerant oil is circulated through said cooling media flow conduit.

6. A cooling suit according to claim 1, wherein said means to pressurize said space includes an excess pressure valve control for regulating said air pump to provide a predetermined pressure.

* * * * *